US010098456B2

(12) United States Patent
Beni et al.

(10) Patent No.: US 10,098,456 B2
(45) Date of Patent: Oct. 16, 2018

(54) BUILT-IN ELECTRICAL HOUSEHOLD APPLIANCE AND HOUSEHOLD APPLIANCE ASSEMBLY AND BUILT-IN FURNITURE UNIT FOR A HOUSEHOLD APPLIANCE

(75) Inventors: Marco Beni, Porcia (IT); Augusto Buosi, Porcia (IT); Vittorio Velli, Porcia (IT); Michele Meneghin, Porcia (IT)

(73) Assignee: Electrolux Home Products Corporation N. V., Brussels (BE)

( * ) Notice: Subject to any disclaimer, the term of this patent is extended or adjusted under 35 U.S.C. 154(b) by 645 days.

(21) Appl. No.: 13/978,317

(22) PCT Filed: Dec. 28, 2011

(86) PCT No.: PCT/IB2011/003340
§ 371 (c)(1),
(2), (4) Date: Jan. 14, 2014

(87) PCT Pub. No.: WO2012/093285
PCT Pub. Date: Jul. 12, 2012

(65) Prior Publication Data

US 2014/0139083 A1 May 22, 2014

(30) Foreign Application Priority Data

Jan. 5, 2011 (IT) ..... PD2011A0001

(51) Int. Cl.
*A47B 96/04* (2006.01)
*A47B 77/08* (2006.01)
(Continued)

(52) U.S. Cl.
CPC ..... *A47B 77/08* (2013.01); *A47B 77/16* (2013.01); *F25D 23/028* (2013.01); *F25D 23/10* (2013.01)

(58) Field of Classification Search
CPC ..... A47B 77/08; A47B 77/10; A47B 77/16; F25D 23/10; F25D 23/028
(Continued)

(56) References Cited

U.S. PATENT DOCUMENTS 1,967,456 A * 7/1934 Swedman ..... F25D 23/082 220/DIG. 3
3,038,218 A 6/1962 Swaneck, Jr. et al.
(Continued)

FOREIGN PATENT DOCUMENTS

CN 1316637 A 10/2001
CN 1898514 A 1/2007
(Continued)

OTHER PUBLICATIONS

International Search Report for PCT/IB2011/003340, dated Sep. 9, 2012, 3 pages.
(Continued)

*Primary Examiner* — Daniel J Troy
*Assistant Examiner* — Timothy M Ayres
(74) *Attorney, Agent, or Firm* — Pearne & Gordon LLP

(57) ABSTRACT

This invention relates to a built-in electrical household appliance (1), suitable for being housed inside a built-in furniture unit (2), the furniture unit comprising a lateral wall defining a surface (4) and a unit door (6) attached to said lateral surface (4) by means of hinges (10*a*, 10*b*). The appliance (1) comprises: a main body (12) defining a space for housing foods or objects, the main body having a side (13) suitable for being placed facing the lateral surface (4) when the electrical household appliance is housed in the furniture unit; a door (11) for access to the space and hinged on one of its sides to the main body (12) in such a manner as to rotate between an open position and a closed position and in such a manner as to present, in the closed position, a
(Continued)

lateral edge (25) thereof facing the lateral surface (4), and being provided with attachment elements (26) suitable for permitting coupling to the unit door (6), in such a way that it is possible to open and close the door by moving the unit door (6). The appliance furthermore shows a distance between said lateral edge (25) of the door (11) and a plane containing an outer surface of said side (13) of the main body (12) there is a distance, in a direction perpendicular to said plane, of at least 5 mm, such that when the electrical household appliance (1) is housed in the furniture unit (2) the side (13) can be arranged adjacent to the lateral surface (4) while the hinges (10*a,* 10*b*) can be accommodated in a space between the door (11) and said lateral surface (4) of said furniture unit, and the door (11) has, along the lateral edge (25), at least one vertical chamfer (22) to avoid interference with the hinges (10*a,* 10*b*) when the door is operated.

19 Claims, 3 Drawing Sheets

(51) Int. Cl.
*F25D 23/02* (2006.01)
*F25D 23/10* (2006.01)
*A47B 77/16* (2006.01)

(58) Field of Classification Search
USPC ..... 312/401, 242, 223.1, 326
See application file for complete search history.

(56) References Cited

U.S. PATENT DOCUMENTS 3,533,190 A * 10/1970 Johnson ..... E06B 3/9641 49/402
4,626,049 A * 12/1986 Gross ..... E05D 7/0407 16/238
5,471,709 A * 12/1995 Lanzani ..... A47L 15/4261 16/238
6,692,093 B1 2/2004 Park et al.
8,104,853 B2 1/2012 Kim et al.
9,528,748 B2 * 12/2016 Joo ..... F25D 23/02
2007/0176526 A1 8/2007 Gomoll et al.
2010/0154457 A1 * 6/2010 Kim ..... E05D 5/12 62/340
2011/0000050 A1 * 1/2011 Lanzani ..... F25D 23/028 16/382
2012/0104909 A1 * 5/2012 Kaplan ..... F25D 23/02 312/204
2013/0033160 A1 * 2/2013 Kleemann ..... F25D 23/10 312/237

FOREIGN PATENT DOCUMENTS

CN 101093131 A 12/2007
CN 101206096 A 6/2008
DE 3242350 A1 * 5/1984 ..... E05D 3/16
DE 10234962 A1 * 2/2004 ..... F25D 23/028
EP 0657609 A1 * 6/1995 ..... E05D 3/04
EP 1936303 6/2008
EP 2722621 A1 * 4/2014 ..... F25D 23/028
JP 62136839 8/1987
JP 3274376 12/1991
JP 5164458 6/1993

OTHER PUBLICATIONS

Translation of Office Action in Chinese Patent Application No. 201180064369.3, dated Dec. 3, 2014.

* cited by examiner

Fig. 1 (KNOWN ART)
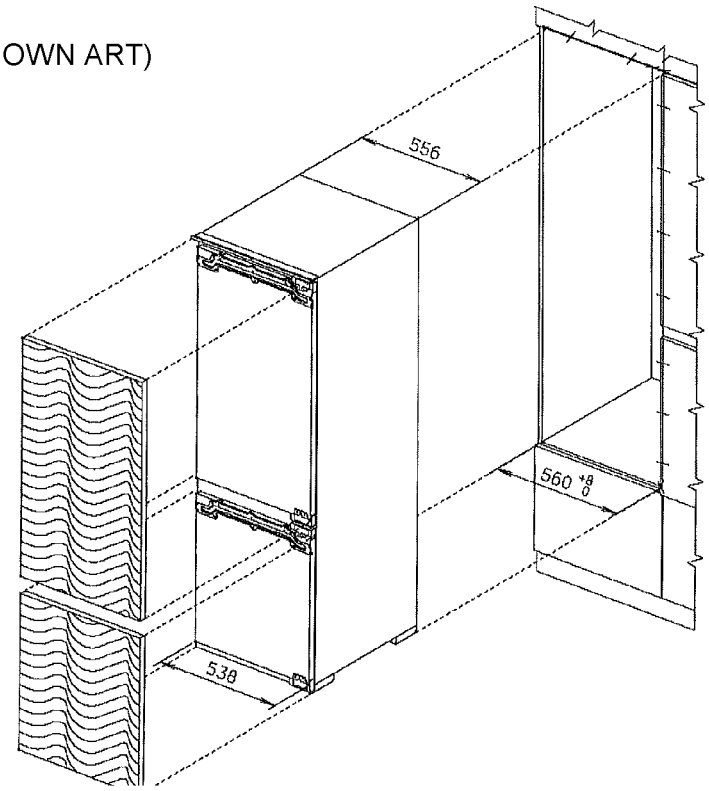
Fig. 2 (KNOWN ART)
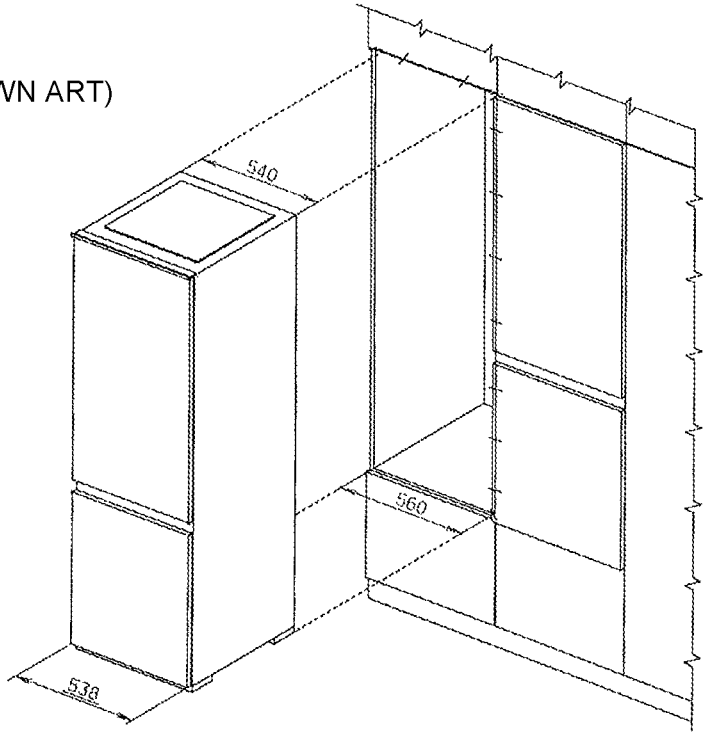

BUILT-IN ELECTRICAL HOUSEHOLD APPLIANCE AND HOUSEHOLD APPLIANCE ASSEMBLY AND BUILT-IN FURNITURE UNIT FOR A HOUSEHOLD APPLIANCE

TECHNICAL SCOPE

The invention relates to a built-in electrical household appliance e.g. a refrigerator, and an assembly formed of the household appliance and a built-in furniture unit.

TECHNOLOGICAL BACKGROUND

Built-in electrical household appliances or those electrical household appliances that are lodged within custom-made furniture units are now particularly appreciated for the beauty that they give to the interior of a given environment.

In this technical scope, two types of construction are known for built-in electrical household appliances. In both types, it is provided that the household appliance is built in to a furniture unit intended for it, within a housing extended between two lateral walls, opposite each other, and between a back wall perpendicular to the two lateral walls and a front opening opposite the back wall.

A first type, known by the name "door-on-door", provides that the front opening of the furniture unit is not closed by a door secured to the same furniture unit but rather that the household appliance comprises a front door equipped with anchor brackets for one or more panels having a desired aesthetic appearance, typically the same appearance as the furniture unit into which the household appliance is installed. Basically, in this type the unit door is directly anchored to the door of the household appliance and is attached to it, hence the name "door-on-door".

According to this first type, since the furniture unit lacks the front unit door and therefore hinges for opening and closing this unit door (which would have to be installed on one of the two inner side walls of the furniture unit), the entire inner space between the two lateral walls can be used for housing the appliance. Consequently, the width of the appliance may be equal to the distance between said walls, less a given quantity, necessary to ensure a minimum clearance between the appliance and the lateral walls, in order to facilitate the insertion of the household appliance in the housing. Typically, for built-in furniture with a door of a nominal width equal to 600 mm a housing width equal to 560 mm is provided in which a household appliance with a width of 556 mm is installed, as denoted in FIG. 1.

According to this first type of construction, the hinges of the door of the household appliance must ensure the correct opening and closing of the appliance without any interference with the other furniture units next to it, and the correct alignment with the door closed with the panels anchored to the appliance door with the door of any other furniture unit next to the one that holds the household appliance. To ensure this coupling that is necessary in the presence of adjacent furniture units for aesthetic reasons, small distances between the front doors of the units, the hinges of the appliance door must also allow the translation to the outside of the door, in addition to the rotation. The major disadvantages of this first type are the cost of these hinges, the need for a system of reinforcements on the furniture unit to install said hinges and the relative complexity of the installation operation of the appliance in the kitchen furniture unit.

A second type of construction for built in appliances is known which is called "sliding", which provides that the front opening of the furniture unit has a front unit door with closure hinged to the furniture unit with a hinge system for furniture units applied to one of the lateral surfaces. The door of the appliance is attached with a sliding coupling to the unit door of the furniture unit to be pulled in opening and closing, allowing opening and closing of the appliance at the same time that the unit door of the furniture unit is opened and closed by the user. In this second type, hinges provided on the door of the furniture unit are constructively simpler and less robust than the hinges provided on the "door-on-door" type of appliances that must support the weight of both doors. For this reason, the total cost of the "sliding" type of hinges of appliances is less than the "door-on-door" type and the system for installing the appliance in the furniture unit is simpler. One of the drawbacks of this solution is the presence of the hinges on the unit door that limit the usable space for housing the appliance. In particular, for built-in furniture units with a nominal width of 600 mm, a housing width equal to 560 mm is provided in which an appliance with a width of 540 mm can be installed, as shown in FIG. 2.

DESCRIPTION OF THE INVENTION

The aim of this invention is to provide a built-in appliance structurally and functionally designed to overcome the drawbacks reported with reference to the prior art cited above, while combining the benefits at the same time. Another aim is to make available an assembly consisting of this built-in appliance and a furniture unit with housing for this appliance.

The Applicant has in particular taken on the problem of creating a household appliance of the "sliding" type with a greater width compared to the traditional ones, i.e. dimensions similar to those of the "door-on-door" type, which may be built into a furniture unit with standard dimensions without interference with the unit door hinges.

The Applicant has found that said type of assembly, including a standard-sized furniture unit and a "sliding" type of appliance with increased lateral dimensions, can be obtained by constructing an appliance in which the door is inserted laterally with respect to the side of the appliance, from the part turned toward the hinges, so as to create sufficient space between the same door and the same lateral walls of the furniture unit on which the hinges are attached to house the same hinges and avoid interference between the door and hinges during the operations of opening and closing the door. Thus, contrary to traditional "sliding" type appliances, it is no longer necessary to have a reduced lateral dimension for the whole appliance, but rather it is sufficient to reduce these dimensions only parallel to the door, while in the area of the sides the appliance can have lateral dimensions typical of the "door-on-door" type of appliances.

To optimize the door's dimensions, in consideration of the overall dimensions occupied by the hinges, the lateral edge of the door may be fitted with a chamfer, either to obtain more space at the fullest part of the hinges, or to avoid interference with the hinges when opening/closing the door.

Clearly, it is also important that the thickness of the door is sized so that the abovementioned space is sufficient to accommodate the hinges over the whole length. Considering the overall dimensions of the hinges now available for these applications, the appliance of this invention has a door with a greater thickness with respect to traditional appliances. In particular, the thickness of the door, considering also the seal applied to the door itself, should preferably be greater than 40 mm. The functional part of the appliance will then have less depth; however this will be more than offset by the increased lateral dimensions.

Due to the invention described above, the Applicant has found that a "sliding" type of appliance can have a width at least equal to that of a "door-on-door" type of appliance. Due to its greater width, the appliance may be constructed with more insulation and/or with greater internal volume available for storing food.

The invention is also related to a built-in appliance-furniture unit assembly as mentioned above, and the furniture unit has a hinged front unit door with furniture unit lateral wall according to the "sliding" solution, with the hinges positioned in the space between the door and the lateral wall.

BRIEF DESCRIPTION OF THE DRAWINGS

This and the other advantages of the invention will be clearer from the detailed description of a preferred but not exclusive example of implementation which follows, for illustrative and not limitative purposes with reference to the attached drawings in which:

FIGS. 1 and 2 are two axonometric exploded views of a built-in appliance and of a furniture unit for housing this appliance of a first and second type, according to the prior art.

PREFERRED WAY OF IMPLEMENTING THE INVENTION

With reference to the attached figures from 3 to 7, a built-in appliance of the known type with the name "sliding" is denoted in its entirety with 1.

Figure 6:
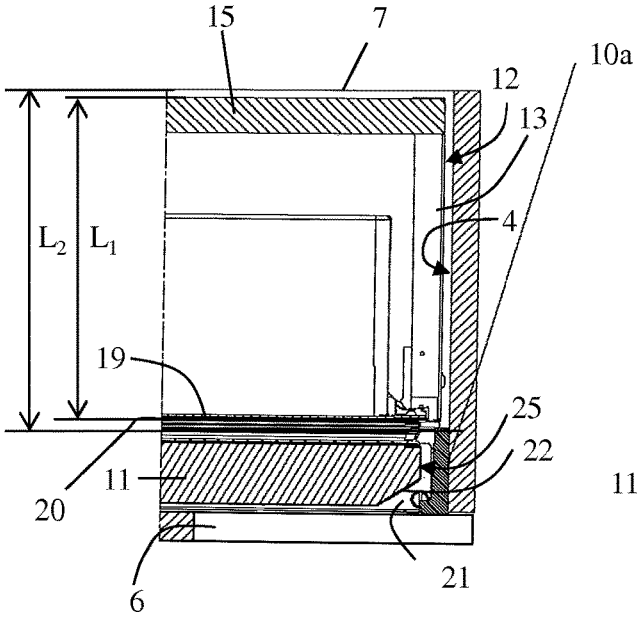
FIGS. 6 and 7 are two sectional view of the assembly of this invention, respectively taken along the lines of sections VI-VI and VII-VII of FIG. 5.
Figure 7:
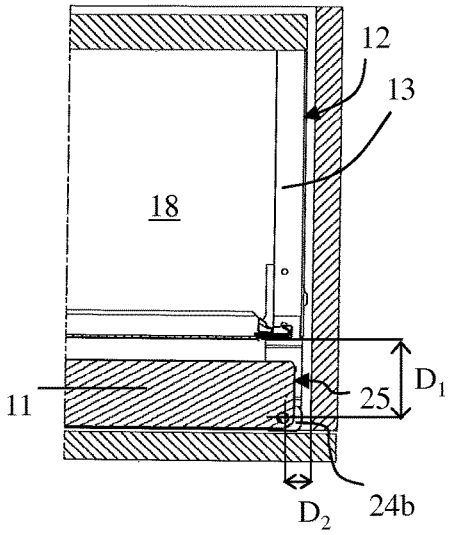

According to the preferred example shown in the figures and described herein, this invention is applicable to a built-in refrigerator. In general, however, this invention is suitable for application to any appliance that may be housed in a furniture unit and with a door that may be attached to a door of said furniture unit, such as for example dishwashers or others. Therefore, the term "appliance" is intended in its broadest sense. As shown in FIGS. 6 and 7, the appliance 1 comprises a body 12 within which a compartment is defined for storing food or objects, and a door 11 provided with a gasket 19 that is, for example, a perimetric seal.

The appliance 1 can be housed within a furniture unit 2 of a known type (FIGS. 3 and 4), constructed for example in wood or plastic, with which it forms an assembly 30. In particular, the appliance is placed within a housing 3 of the furniture unit 2 with a substantially parallelepiped shape being extended between a first and second lateral surface 4, 5 opposite each other (defined by the furniture unit's respective lateral walls), between a front unit door 6 and a back surface 7 (FIG. 6) opposite the unit door 6 and between a base surface 8 (FIG. 4) and a top surface 9 (FIG. 3), also opposing each other. The top and/or back walls may also not be present in alternative examples of this invention not depicted. If the appliance has no back wall, "back surface" means the surface that connects the end side of the lateral surfaces 4 and 5 parallel to the unit door 6 when closed, whereas "top surface" means the surface that connects the end side of the lateral surfaces 4 and 5 parallel to the base 8.

The surfaces 4, 5, 7, 8 and 9 and the unit door 6 are oriented so that when the furniture unit 2 is installed resting on a floor P, the lateral surfaces 4, 5, the unit door 6 and the back surface 7 are oriented according to the respective vertical perpendicular planes to the floor P, whereas the base surfaces 8 and the top 9 are oriented according to parallel horizontal planes to the floor P. With respect to the furniture unit 2, a depth direction is defined, perpendicular to the back surface 7 and a width direction, perpendicular to the lateral surface 4, 5.

Figure 3:
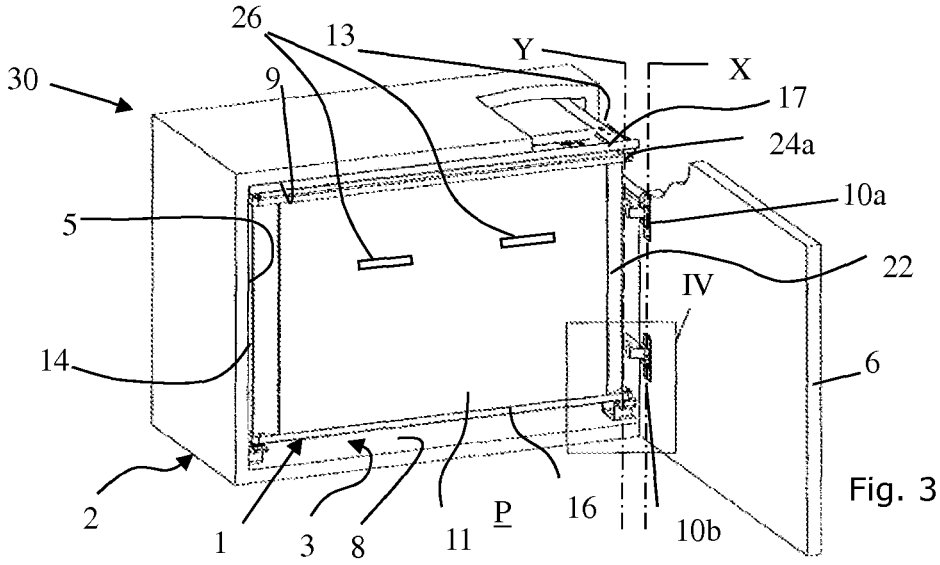
FIG. 3 is an axonometric partially sectional view of an assembly according to this invention consisting of a built-in appliance and a related built-in furniture unit, with the door of the appliance closed and the unit door of the furniture unit decoupled from the appliance door and open, for ease of representation.
Figure 4:
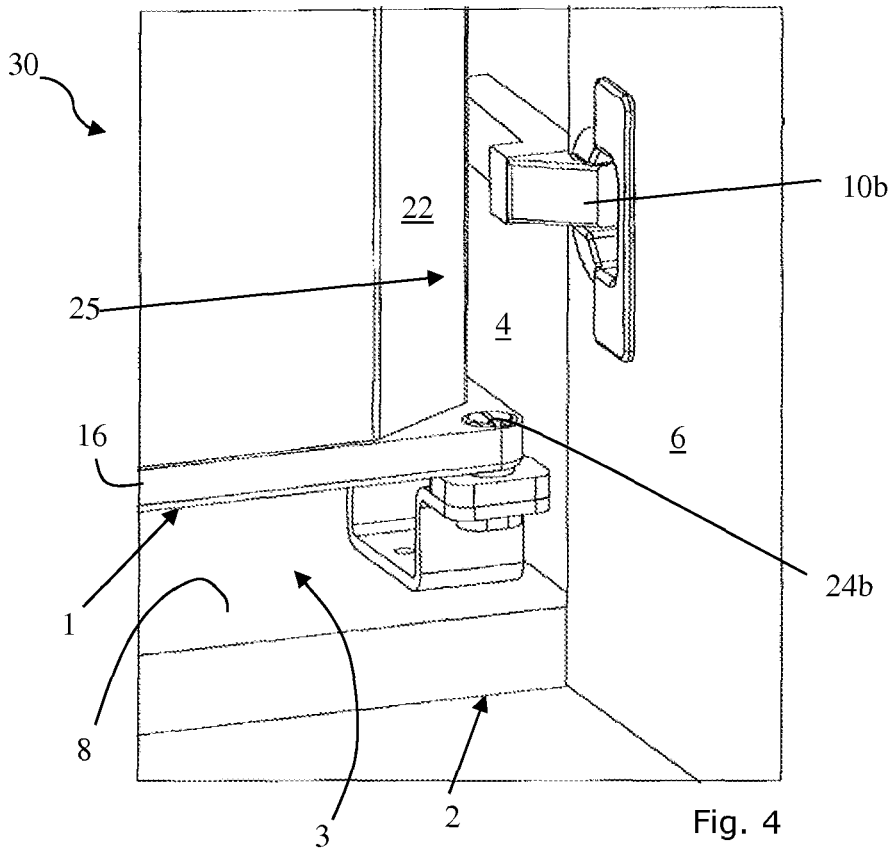
FIG. 4 is a perspective view on an enlarged scale of Detail IV of FIG. 3.

The unit door 6 is attached to the first lateral surface 4 using a system of hinges for furniture units 10*a*, 10*b* of a known type, applied to the first lateral surface 4, to allow the movement of the unit door 6 between a first closed position (FIGS. 5, 6 and 7) and a second open position (FIGS. 3 and 4). The hinges 10*a*, 10*b* are preferably of the "quadrilateral" type, i.e. with four axes of rotation, to allow a roto-translational movement of the unit door, with elliptic type trajectories. For ease of description and representation, said complex motion will subsequently be equivalent to a simple rotation around a single axis, denoted with an X. The X axis is spaced from the lateral surface 4.

In the figures, the number of hinges shown is equal to two; however a different number of hinges can be used.

Considering the hinges used today for these applications, the overall dimensions of each hinge 10*a*, 10*b* along the first lateral surface 4 (i.e. along the aforementioned direction of depth), starting from the edge of the unit door 6, is typically between 20 and 70 mm, in particular between 50 and 65 mm, while the space occupied by each hinge 10*a*, 10*b* in the direction perpendicular to the first lateral surface 4 (i.e. along the aforementioned width direction) is typically between 10 and 20 mm, in particular between 16 and 18 mm.

The unit door 6 may be attached with a sliding coupling with the door 11 of the appliance 1 to pull it between the opened and closed position so that the user can open and close the appliance 1 by using e.g. a handle (not shown) of the unit door 6. The coupling between the unit door 6 and the door 11 is in itself conventional for built-in "sliding" type appliances and is therefore not described in detail.

The body 12 of the appliance 1 comprises a first and second lateral wall (or side) 13, 14 (FIGS. 3, 6 and 7) respectively, likely to face the first and second lateral surface 4, 5 of the housing 3, when the appliances is placed in the latter. The body 12 is furthermore provided with a back wall 15 (FIG. 6), likely to face the back surface 7 of the furniture unit 2 when the appliance 1 is placed in the housing 3, as well as a lower wall 18 (FIG. 7) and an upper wall (not visible in the figures).

The door 11 is preferably provided with a lower plate 16 and an upper plate 17 (FIGS. 3 and 4), which function as coupling elements, respectively likely to face said base 8 and top surfaces 9 of the housing 3.

With respect to the appliance 1 a depth direction perpendicular to the back wall 15 and a width direction perpendicular to the lateral walls 13, 14; these directions are respectively aligned with the width and depth directions of the furniture unit 2 when the appliance is placed in the housing 3.

The lateral walls 13, 14, the back wall 15 and the lower 18 and upper walls (not shown) define an internal volume of the body 12 that can be closed using the door 11. The door 11 is hinged at the ends of the lower 16 and upper 17 plates turned towards the lateral side 4 of the housing 3, to the body 12 able to rotate around a pivot axis Y (FIG. 3).

Figure 5:
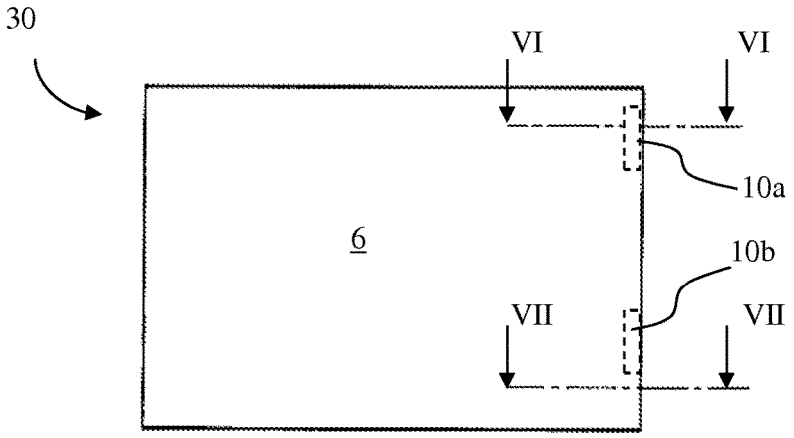
FIG. 5 shows a front view of the assembly of FIG. 3.

FIGS. 3 and 4 show, for a better view of the different parts, the door 11 and the unit door 6 decoupled from them (in particular, with the door 11 in the closed position and the unit door 6 in the open position). Indeed, between the appliance door 11 and the unit door 6, in a definitive configuration of the assembly, there are attachment elements with sliding coupling 26 (FIG. 3), that allows the door 11 to be pulled when the unit door 6 is moved by the user according to the "sliding" coupling concept of the prior art. In FIGS. 5 to 7, however, the door 11 and the unit door 6 are arranged in the closed position. In its closed position, door 11 is drawn closer to the body 12 along a closure line 20 (shown in FIG. 6), along which, in the design variant in which the appliance is comprised of a refrigerator, is advantageously provided with the gasket 19, e.g. made of PVC or thermoplastic material to enable the appliance 1 to seal.

To prevent interference between the body 12 and the door 11 during rotation of the same door between the closed and open positions, it is important that the hinge axis Y of the door 11 is spaced from the closure line 20. With reference to FIG. 7 (where the distances are not to scale) the distance of the Y axis from the closure line 20, indicated by D1, is conveniently greater than the distance of the Y axis from the X axis, denoted by D2.

The hinge of the door 11 to the body 12 of the appliance 1 is obtained by using a pair of hinges for appliances 24*a*, 24*b* (FIGS. 3, 4), in itself conventional and therefore not described in detail, placed, for example, at the ends of the lower 16 and upper 17 plates of door 11. As in the case of the hinges of the furniture unit 2, the door 11 may be hinged to the body 12 of the appliance 1 using an arbitrary number of hinges.

As shown in FIG. 6, the body 12 is dimensioned so that the overall dimension L1 of the body 12 in the housing 3 along the abovementioned depth direction (i.e. the length of the sides 13, 14 of the body 12) is less than or equal to the distance L2 of the hinges for furniture units 10*a*, 10*b* from the back surface 7. Thus, by placing the appliance 1 toward the back of the housing 3 (i.e. so that the back wall 15 almost touches the back surface 7), the body 12 will occupy a portion of space not occupied by the hinges 10*a*, 10*b* and specifically the portion of space between the back surface 7 and the hinges for furniture units 10*a*, 10*b* (in the depth direction). In this way, the lateral wall 13 will face a portion of the side surface 4 not occupied by the hinges 10*a*, 10*b*, thus avoiding the presence of the hinges 10*a*, 10*b* between the lateral wall 13 and the lateral surface 4. The body 12 can therefore be dimensioned to occupy substantially all the available distance between the lateral surfaces 4, 5, i.e. its width may be made equal to the distance between the lateral surfaces 4, 5 less a given quantity necessary to guarantee a minimum span between the appliance 1 and the lateral walls 4, 5 in order to facilitate the insertion of the appliance 1 into the housing 3 (similar to that which occurs in the "door-on-door" appliances). Consequently, the width of the body 12 (i.e. the maximum width of the appliance 1) may be greater than the distance between the hinges for furniture units 10*a*, 10*b* and the second lateral surface 5.

In practice, for a built-in furniture unit 2 with a nominal width of 600 mm in which a housing 3 with a width equal to 560 mm is typically provided, it is possible to install a "sliding" type of appliance 1 with a width well over 540 mm, preferably even greater than 550 mm, for example equal to 556 mm. Therefore, due to this invention it is possible to construct a furniture unit-appliance assembly 30 in which the appliance is the "sliding" type and has the same maximum dimensions that a "door-on-door" type of appliance would have in the same furniture unit.

To install the appliance 1 in the furniture unit 2, a procedure is necessary according to a method which comprises a first phase of inserting the body 12 in the housing 3 when it does not have hinges for furniture units 10*a*, 10*b* and of the door 6; a second phase for applying the hinges for furniture units 10*a*, 10*b* to the first lateral surface 4; a third phase to attach the door 6 to the hinges for furniture units 10*a*, 10*b*; and fourth phase of attaching the unit door 6 to the appliance door 11 with a coupling attachment.

Preferably, the thickness of the door 11, including the overall dimensions of the hinges 10*a*, 10*b* along the first lateral surface 4 (in the abovementioned depth direction), so that the door 11 ends up approximately extended around the closure line 20 to the hinging axis Y. In current refrigerators the thickness of the door, including the seal, is approximately 37 mm. The thickness of the door (including the seal), according to this invention, is preferably between 40 and 60 mm, still more preferably between 45 and 60 mm.

According to the other design variants not represented, the door 11 may however have different thicknesses, possibly lower than the overall dimensions of the hinges 10*a*, 10*b* along the first lateral surface 4 (in the abovementioned depth direction).

Preferably, in order to create this condition, the distance of the hinging Y-axis from the closing line 20 is substantially equal to the overall dimensions of the hinges for the furniture units 10*a*, 10*b* along the first lateral surface 4 or more than 90% of these overall dimensions.

The door 11 is shaped so that between it and the first surface 4 an empty space 21 is defined (see FIG. 6) for housing the hinges for furniture units 10*a*, 10*b*. This space 21 is obtained either by making the door 11 concave with respect to the side 13, either constructing a chamfer 22 on the lateral edge 25 toward the hinges 10*a*, 10*b*, in particular on the front part of this edge, as shown in FIG. 6.

To this end, the door 11 is dimensioned so that its width is less than the width of the body 12, and in particular less than the distance between the hinges for furniture units 10*a*, 10*b* and according to the lateral surface 5. In particular, while the minimum distance between the lateral edge 25 of the door and a plane containing the external surface of the side 13 (or the surface of the side 13 facing the lateral surface 4 of the furniture unit 2), and typically between 1 and 5 mm, according to this invention this distance is greater than 5 mm, in particular between 5 and 30 mm, preferably between 15 and 30 mm).

The chamfer 22 delimits the space 21 in correspondence of an area of operation of the moving parts of the hinges 10*a*, 10*b*. In particular, because the hinges 10*a*, 10*b* have a protruding portion (having, in the part attached to the furniture unit 2, a substantially L-shaped profile), the chamfer 22 is used to avoid interference between the door 11 and this more protruding portion, especially in the rotation phase of the door 11.

The chamfer 22 may have a flat shape, or another shape, e.g. concave. In addition, the chamfer 22 may be continuous or may be located only at the hinges 10*a*, 10*b*. In other words, the chamfer 22 may be constructed along the entire height of the lateral edge 25 from one hinge to the other for appliances 24*a*, 24*b* (i.e. from one plate 16 to the other 17 as shown in FIGS. 3, 4), or only in areas of the lateral edge 25 which face the hinges 10*a*, 10*b*. Therefore, the lateral edge 25 may also have a sharp edge in the area not occupied by the hinges 10*a*, 10*b*, and a chamfer located, similar to the chamfer 22, in the area occupied by the hinges 10*a*, 10*b*. However, any other shape that allows the housing of the hinges 10*a*, 10*b* of the furniture unit 2 is covered in the invention.

This invention allows one to obtain an appliance 1 and a built-in appliance and furniture unit assembly 30 in which the body 12 of the appliance is more extended in width than the bodies of the "sliding" type of appliances. This increased width may allow one to design an appliance with a thicker layer of insulation and/or a greater internal volume for the allocation of food and drink.

Any loss of volume corresponding to the fact of having reduced the depth of the body 12 to not interfere with the hinges of the furniture units 10*a*, 10*b* may be compensated by "digging out" more space within the thickness of the door 11. This results thus in both advantages of the overall dimensions of the "door-on-door" type and cost advantages of the "sliding" type.

The invention thus solves the problem reported in reference to the cited prior art, resulting at the same time in further advantages, including that of being able to use appliances of constant width although constructed according to two different types, with the obvious advantage of being able to use a greater number of components on one or on the other type of appliances indifferently.

The invention claimed is:

1. An electrical household appliance (1), suitable for being housed inside a furniture unit (2), said furniture unit (2) comprising a lateral wall defining a lateral surface (4) and a unit door (6) attached to said lateral surface (4) by means of hinges (10*a*, 10*b*), said electrical household appliance (1) comprising:

a main body (12) defining a space for housing foods or objects, said main body having a side (13);

an appliance door (11) for access to the space and hinged on a side of the appliance door (11) to the side (13) of the main body (12) in such a manner as to rotate between an open position and a closed position, wherein in the closed position, a lateral edge (25) of the appliance door (11) faces a plane containing an outer surface of said side (13) of the main body (12), further wherein the appliance door (11) is provided with attachment elements (26), wherein:

said lateral edge is spaced from said plane laterally inward from the outer surface of said side (13) of the main body (12), between said lateral edge (25) of the appliance door (11) and said plane there is a distance, in a direction normal to said plane, of at least 5 mm, and said appliance door (11), along said lateral edge (25), has at least one vertical chamfer (22).

2. The electrical household appliance (1) according to claim 1, wherein said distance is between 15 and 30 mm.

3. The electrical household appliance (1) according to claim 1, wherein a width of said main body (12) is greater than 540 mm.

4. The electrical household appliance (1) according to claim 1, wherein said at least one chamfer (22) extends vertically for a full height of said appliance door (11).

5. The electrical household appliance (1) according to claim 1, wherein said at least one chamfer (22) comprises at least two chamfers spaced apart from each other vertically and provided in a region of said hinges (10*a*, 10*b*).

6. The electrical household appliance (1) according to claim 1, wherein said appliance door (11) has on an inside thereof a gasket (19) for closure on said main body (12), and in that a total thickness of the appliance door including the gasket is between 40 and 60 mm.

7. The electrical household appliance (1) according to claim 6, wherein said total thickness is between 45 and 60 mm.

8. The electrical household appliance (1) according to claim 1, wherein said at least one vertical chamfer (22) comprises a flat surface that is transverse and non-orthogonal to said plane.

9. The electrical household appliance (1) according to claim 1, wherein said at least one vertical chamfer (22) comprises a flat surface that is transverse and non-orthogonal to a front surface of the appliance door (11).

10. An assembly (30) comprising an electrical household appliance (1) and a furniture unit (2) for built-in electrical household appliances, in which said furniture unit (2) is provided with a housing (3) for said electrical household appliance (1), said housing (3) extending between a first and a second lateral surface (4, 5) opposed to each other and between a unit door (6) attached to said first lateral surface (4) by means of unit hinges (10*a*, 10*b*) and a back surface (7) opposite said unit door (6), and wherein said electrical household appliance (1) comprises:

a body (12) provided with a first and a second lateral wall (13, 14) respectively facing said first and said second lateral surface (4, 5) of said housing (3), and an appliance door (11) hinged to said body (12) so as to be rotatable between a closed position in which said appliance door (11) is alongside said body (12) along a line of closure (20) and an open position, said appliance door (11) being attached to said unit door (6) so as to be able to be pulled between said closed position and said open position, said appliance door (11) being hinged to said body (12) of said electrical household appliance (1) by means of appliance hinges (24*a*, 24*b*) that are separate from said unit hinges (10*a*, 10*b*), wherein said body (12) occupies in said housing (3) a space directly between said unit hinges (10*a*, 10*b*) and said back surface (7), and in that said appliance door (11) is configured in such a manner that between said appliance door and said first lateral surface (4) there is defined at least one empty space (21) for housing said unit hinges (10*a*, 10*b*).

11. The assembly (30) according to claim 10, wherein a lateral edge (25) of said appliance door (11) facing towards said unit hinges (10*a*, 10*b*) has a chamfer (22) in order to avoid interference between said appliance door and said hinges (10*a*, 10*b*) during rotation between said closed position and said open position.

12. The assembly (30) according to claim 11, wherein said appliance hinges (24*a*, 24*b*) comprises a pair of appliance hinges (24*a*, 24*b*) placed at opposite ends of said lateral edge (25), said pair of appliance hinges (24*a*, 24*b*) protruding with respect to said chamfer (22).

13. The assembly (30) according to claim 11, wherein said chamfer (22) extends along said lateral edge (25) from one to the other of said pair of appliance hinges (24*a*, 24*b*).

14. The assembly (30) according to claim 10, wherein said electrical household appliance (1) has a maximum width greater than 540 mm.

15. The assembly (30) according to claim 10, wherein said appliance door (11) is hinged to said body (12) so as to be rotatable about a hinge axis (Y) and a distance between said hinge axis (Y) and said line of closure (20) is greater than 90% of an overall dimension of said unit hinges (10*a*, 10*b*) along said first lateral surface (4).

16. The assembly (30) according to claim 15, wherein said hinge axis (Y) is spaced apart from said line of closure (20) to such a degree as to prevent interference between said body (12) and said appliance door (11) during rotation between said closed position and said open position.

17. The assembly (30) according to claim 10, wherein in the closed position, said appliance door (11) occupies a space directly between said unit hinges (10*a*, 10*b*) and said second lateral surface (5).

18. The assembly (30) according to claim 10, wherein said appliance hinges (24*a*, 24*b*) comprises a pair of appliance hinges (24*a*, 24*b*) placed at opposite sides of said appliance door (11), further wherein said unit hinges (10*a*, 10*b*) are located vertically between said pair of appliance hinges (24*a*, 24*b*).

19. The assembly (30) according to claim 10, wherein said appliance hinges (24*a*, 24*b*) are spaced from said unit hinges (10*a*, 10*b*).

* * * * *